US008091260B2

(12) United States Patent
Armwood

(10) Patent No.: US 8,091,260 B2
(45) Date of Patent: Jan. 10, 2012

(54) HANDHELD ILLUMINATED WARNING SIGN

(76) Inventor: Kenneth Armwood, Sparta, NJ (US)

( * ) Notice: Subject to any disclaimer, the term of this patent is extended or adjusted under 35 U.S.C. 154(b) by 412 days.

(21) Appl. No.: 11/643,355

(22) Filed: Dec. 21, 2006

(65) Prior Publication Data

US 2007/0209255 A1 Sep. 13, 2007

Related U.S. Application Data

(60) Provisional application No. 60/753,562, filed on Dec. 23, 2005.

(51) Int. Cl.
*G09F 21/02* (2006.01)

(52) U.S. Cl. ..... 40/586; 40/541

(58) Field of Classification Search ..... 40/586, 40/781

See application file for complete search history.

(56) References Cited

U.S. PATENT DOCUMENTS

| | | | | | |
|---|---|---|---|---|---|
| 3,075,174 | A | * | 1/1963 | Orszulak | 340/908 |
| 3,279,110 | A | * | 10/1966 | Lelicoff | 40/555 |
| 3,435,412 | A | * | 3/1969 | Bohrer, Sr. | 340/908 |
| 3,821,860 | A | * | 7/1974 | Patty | 40/555 |
| 4,042,919 | A | * | 8/1977 | Patty | 340/321 |
| 4,594,802 | A | * | 6/1986 | Field | 40/661 |
| D306,706 | S | | 3/1990 | Hansel | |
| 4,984,798 | A | * | 1/1991 | Silberstein | 273/157 R |
| 5,276,424 | A | | 1/1994 | Hegemann | |
| 5,551,177 | A | * | 9/1996 | Cowgill et al. | 40/610 |
| D382,218 | S | | 8/1997 | Hall | |
| 5,694,110 | A | * | 12/1997 | Clifford | 340/321 |
| 5,755,051 | A | * | 5/1998 | Zumbuhl | 40/586 |
| 6,035,567 | A | * | 3/2000 | Cameron | 40/607.04 |
| 6,134,820 | A | | 10/2000 | Martinez | |
| 6,239,691 | B1 | | 5/2001 | Preisler | |
| 6,253,477 | B1 | * | 7/2001 | Balint | 40/612 |
| 6,409,358 | B1 | * | 6/2002 | Grover | 362/109 |
| 2004/0062032 | A1 | * | 4/2004 | Mass | 362/84 |
| 2004/0067032 | A1 | * | 4/2004 | Sartori | 385/123 |

* cited by examiner

*Primary Examiner* — Casandra Davis
(74) *Attorney, Agent, or Firm* — James Ray & Assoc

(57) ABSTRACT

A handheld illuminated warning sign including front and back translucent plastic members, each having a predetermined size and a predetermined shape, connected together to form the sign. At least one of the translucent plastic members having a predetermined color and warning indicia thereon. A mechanism is engageable with each of the translucent plastic members at a first portion thereof for securing them together. A generally hollow handle member, having a predetermined length, is engageable with a second portion of such translucent plastic members for holding the sign. A light is disposed at one end of such handle and between the translucent plastic members for lighting the sign. A battery is disposed within the handle and electrically connected to the light and a switch on such handle is connected between the light and battery for turning on and shutting off such light.

18 Claims, 2 Drawing Sheets

HANDHELD ILLUMINATED WARNING SIGN

CROSS REFERENCE TO RELATED APPLICATION

This application is closely related to and claims priority from U.S. Provisional Patent Application Ser. No. 60/753,562 filed on Dec. 23, 2005.

FIELD OF THE INVENTION

The present invention relates, in general, to warning signs and, more particularly, the invention relates to a handheld warning sign to control traffic and, still more particularly, the invention relates to a handheld illuminated warning sign for use by school crossing guards, traffic cops and road construction crews.

BACKGROUND OF THE INVENTION

Prior to the conception and development of the present invention, as is generally well known in the prior art, handheld warning signs have been in existence for many years. These signs are often used by school crossing guards, traffic cops and road construction crews to warn motorists when they need to slow down or stop depending on the situation.

However, present day handheld warning signs are not always easily visible to motorists, especially from a distance or during inclement weather, thus increasing the possibility for accidents at school crossings, crosswalks, intersections, construction sites, etc.

SUMMARY OF THE INVENTION

The present invention provides a handheld illuminated warning sign. The handheld sign includes a first translucent plastic member which has each of a first predetermined size, a first predetermined shape, at least one predetermined color and predetermined warning indicia. Such first translucent plastic member being one of a front portion and a back portion of the handheld sign. The handheld sign also includes a second translucent plastic member which has each of a second predetermined size and a second predetermined shape. The second translucent plastic member being an opposed one of the front and back portion of such handheld sign. There is a means engageable with each of such first and second translucent plastic members at a first predetermined portion thereof for securing such first translucent member to the second translucent member. Additionally, there is a generally hollow handle member engageable with a second predetermined portion of such first and second translucent plastic members for holding the sign. A light is disposed at one end of such handle member and between such first and second translucent plastic members for lighting such sign. The handheld sign also has a battery disposed within such generally hollow handle member and electrically connected to the light. Finally, a switch is disposed on such handle member and is connected between such light and the battery for turning on and shutting off such light.

OBJECTS OF THE INVENTION

It is, therefore, one of the primary objects of the present invention to provide a handheld illuminated warning sign which will be visible from greater distances to minimize certain types of accidents.

Another object of the present invention is to provide a handheld illuminated warning sign which is easy to operate.

Still another object of the present invention is to provide a handheld illuminated warning sign which is relatively lightweight.

Yet another object of the present invention is to provide a handheld illuminated warning sign which is rather inexpensive to produce.

An additional object of the present invention is to provide a handheld illuminated warning sign which can be used for a variety of purposes.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 3:
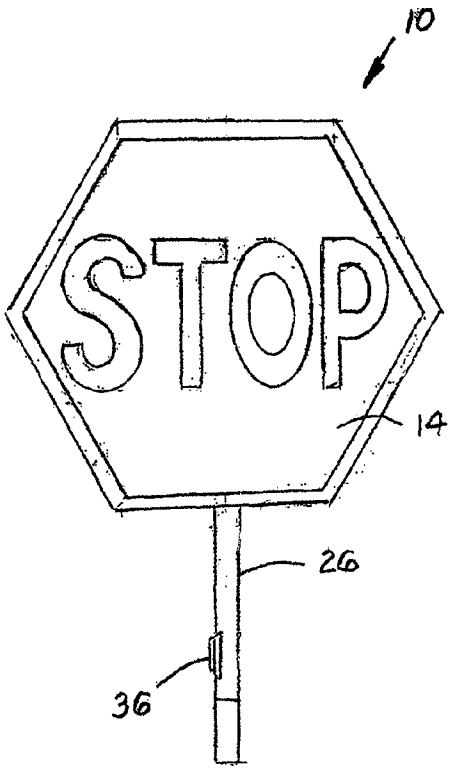
FIG. 3 is a back view of the handheld sign illustrated in FIGS. 1 and 2.
Figure 2:
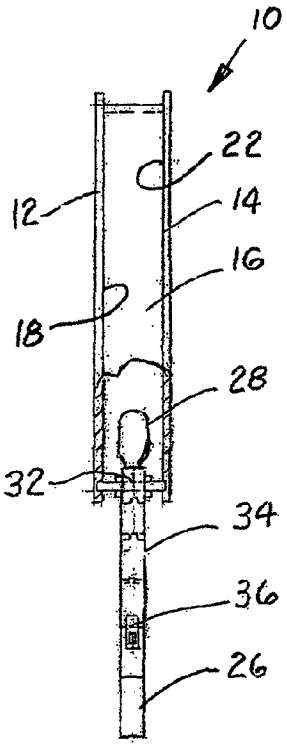
FIG. 2 is a side view of the handheld sign, illustrated in FIG. 1, with a portion removed revealing a light between each face of the warning sign and electric power source.
Figure 1:
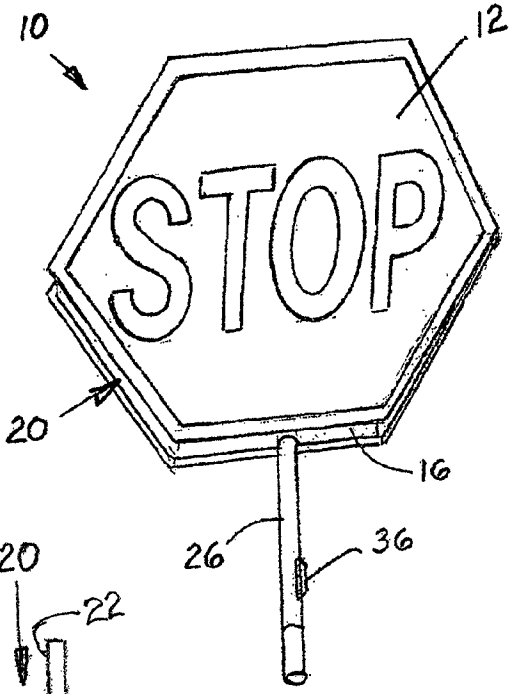
FIG. 1 is a front perspective view of the handheld illuminated warning sign assembled together according to a presently preferred embodiment of the present invention.
Figure 7:
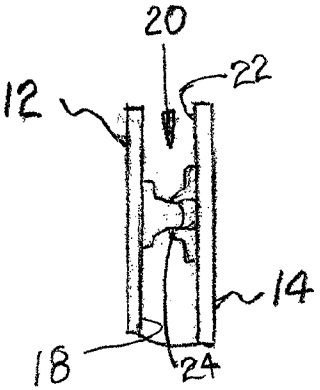
FIG. 7 is partial view illustrating the use of snaps to hold the front and back portions of the sign together.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made, more particularly, to FIGS. 1-7. Illustrated therein is one presently preferred embodiment of a handheld illuminated warning sign, generally designated 10. Such handheld illuminated warning sign 10 includes a first translucent plastic member 12 having each of a first predetermined size, a first predetermined shape, at least one predetermined color and predetermined warning indicia. This first translucent plastic member 12 being one of a front portion and a back portion of handheld sign 10.

The handheld sign 10 also includes a second translucent plastic member 14 having each of a second predetermined size and a second predetermined shape. Such second translucent plastic member 14 being an opposed one of the front and back portions of such handheld sign 10.

A means, generally designated 20, is engageable with each of the first and second translucent plastic members 12 and 14, respectively, at a first predetermined portion thereof for securing first translucent plastic member 12 to the second translucent plastic member 14.

The securing means 20 is, preferably, track members 16 having first and second portions disposed between both an inner surface 18 of first translucent plastic member 12 and an inner surface 22 of second translucent plastic member 14 along just the upper and lower edges of translucent plastic members 12 and 14. Such securing means 20 preferably includes a predetermined plurality of snaps 24 having a first portion disposed on the inner surfaces 18 and 22 of translucent plastic members 12 and 14, and a second portion disposed on the outer surfaces of the two tracks 16. The snaps 24, or alternatively hook and loop (Velcro®) fasteners, make it easy to take apart for replacing the light bulb 28, or for repair or replacement of translucent members 12 and 14.

A generally hollow handle member 26, having a predetermined length, is engageable with a predetermined portion of the lower of tracks 16, for holding the sign 10. A light 28, preferably a blinker, is disposed at one end 32 of the handle member 26 between first and second translucent plastic members 12 and 14, respectively, for lighting the handheld sign 10. The predetermined length of handle member 26 is preferably about twelve inches.

At least one battery 34 is disposed within the handle member 26 and electrically connected to such light 28. Such at least one battery 34 is one of disposable and rechargeable.

Finally, a switch 36 is disposed on the handle member 26 and connected between such light 28 and at least one battery 34 for turning on and shutting off the light 28.

The first predetermined size and first predetermined shape of such first translucent plastic member 12 are, preferably, substantially identical to the second predetermined size and second predetermined shape of such second translucent plastic member 14, respectively. Such first and second predetermined shapes will preferably be octagonal.

The at least one predetermined color of first translucent plastic member 12 will preferably be red and white, and the predetermined warning indicia on such first translucent plastic member 12 is preferably stop.

In a presently preferred embodiment of the invention, the second translucent plastic member 14 will also include at least one predetermined color and predetermined warning indicia. The at least one predetermined color of such second translucent plastic member 14 will be either red and white, or orange and black. Such predetermined warning indicia on the second translucent plastic member 14 is one of stop and slow.

Figure 6:
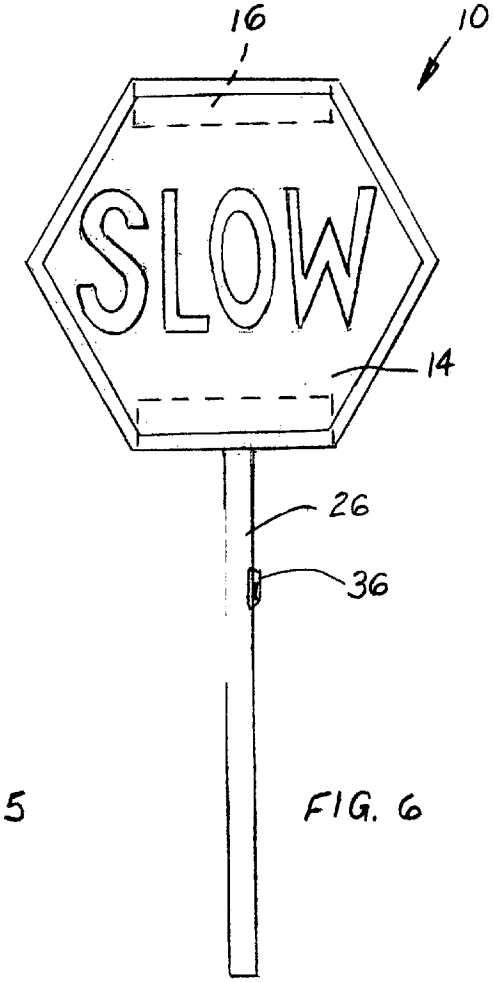
FIG. 6 is a back view of the handheld sign having an elongated handle member according to another embodiment of the present invention.
Figure 5:
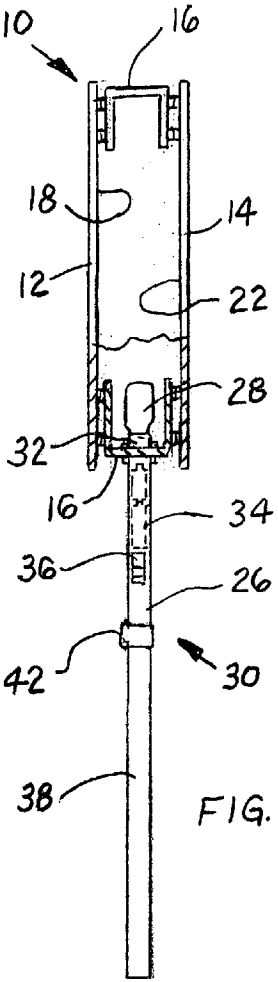
FIG. 5 is a side view of the handheld sign, illustrated in FIG. 4, with a portion removed revealing a light between each face of the warning sign and electric power source.
Figure 4:
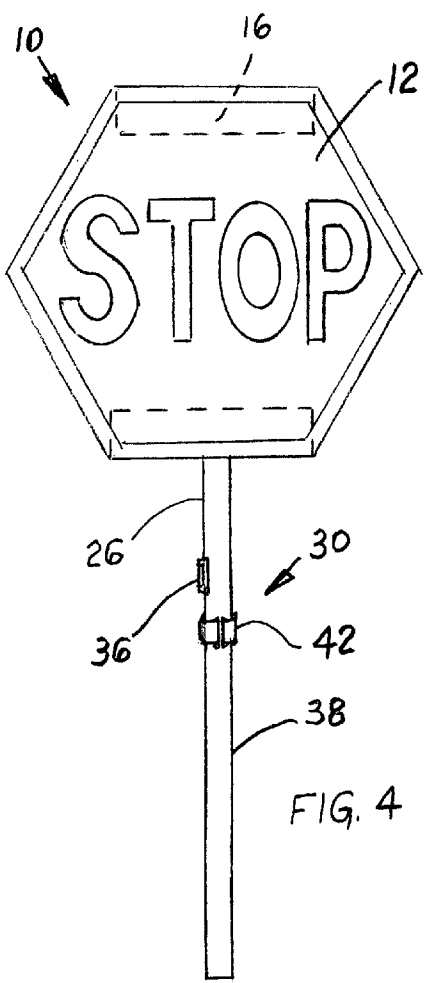
FIG. 4 is a front view of the handheld sign attached to a pole according to another embodiment of the present invention.

Finally, road construction crews often use long poles about six feet in length having warning signs attached to one end thereof that only need to be turned to display either stop on one side of the sign or slow on the other side of the sign. Therefore, as seen in FIGS. 4 and 5, the handheld sign 10 may include a means, generally designated 30, engageable with the handle member 26 for attaching such handheld sign 10 to pole 38. The attaching means 30 is, preferably, a clamp 42. However, as seen in FIG. 6, the predetermined length of handle member 26 of sign 10 may be made longer than the preferred length of twelve inches, such as six feet in length, wherein clamp 42 and pole 38 would not be necessary.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A handheld illuminated warning sign, said handheld sign comprising:

(a) a first translucent planar plastic member having each of a first predetermined size, a first predetermined shape, at least one predetermined color and predetermined warning indicia, said first translucent plastic member being one of a front and a back portion of said handheld sign;

(b) a second translucent planar plastic member having each of a second predetermined size and a second predetermined shape, said second translucent plastic member being an opposed one of said front and said back portion of said handheld sign;

(c) a plurality of releasable snaps with a first portion Disposed on an inner surface of said first translucent planar plastic member and a second portion disposed on an inner portion of said second translucent planar plastic member;

(d) a generally hollow handle member having a predetermined configuration, said handle member engageable with a predetermined portion of said first and second translucent plastic members for holding said sign;

(e) a light disposed at one end of said handle member and between said first and said second translucent planar plastic members for lighting said handheld sign;

(f) at least one battery disposed within said handle member and electrically connected to said light; and (g) a switch disposed on said handle member and connected between said light and said battery for turning on and shutting off said light.

2. A handheld sign, according to claim 1, wherein said first predetermined size and said first predetermined shape of said first translucent plastic member are substantially identical to said second predetermined size and said second predetermined shape of said second translucent plastic member, respectively.

3. A handheld sign, according to claim 2, wherein said first and said second predetermined shapes are octagonal.

4. A handheld sign, according to claim 3, wherein said at least one predetermined color of said first translucent plastic member includes red and white.

5. A handheld sign, according to claim 4, wherein said predetermined warning indicia on said first translucent plastic member is stop.

6. A handheld sign, according to claim 1, wherein said second translucent plastic member includes at least one predetermined color and predetermined warning indicia.

7. A handheld sign, according to claim 6, wherein said first predetermined size and said first predetermined shape of said first translucent plastic member are substantially identical to said second predetermined size and said second predetermined shape of said second translucent plastic member, respectively.

8. A handheld sign, according to claim 7, wherein said first and said second predetermined shapes are octagonal.

9. A handheld sign, according to claim 8, wherein said at least one predetermined color of said first and said second translucent plastic members includes red and white.

10. A handheld sign, according to claim 9, wherein said predetermined warning indicia on said first and said second translucent plastic members is stop.

11. A handheld sign, according to claim 1, wherein said at least one battery is one of disposable and rechargeable.

12. A handheld sign, according to claim 1, wherein said handheld sign further includes a means engageable with said handle member for attaching said handheld sign to a pole.

13. A handheld sign, according to claim 12, wherein said means engageable with said handle member for attaching said handheld sign to said pole is a clamp.

14. A handheld sign, according to claim 1, wherein said second translucent plastic member includes at least one predetermined color and predetermined warning indicia.

15. A handheld sign, according to claim 14, wherein said first predetermined size and said first predetermined shape of said first translucent plastic member are substantially identical to said second predetermined size and said second predetermined shape of said second translucent plastic member, respectively.

16. A handheld sign, according to claim 15, wherein said first and said second predetermined shapes are octagonal.

17. A handheld sign, according to claim 16, wherein said at least one predetermined color of said first translucent plastic member includes red and white and said at least one predetermined color of said second translucent plastic member includes orange and black.

18. A handheld sign, according to claim 17, wherein said predetermined warning indicia on said first translucent plastic member is stop and said predetermined warning indicia on said second translucent plastic member is slow.

* * * * *